United States Patent [19]

Grote et al.

[11] 4,230,007

[45] Oct. 28, 1980

[54] FLEXIBLE MEAT SLICING BLADE AND SUPPORT THEREFOR

[75] Inventors: James E. Grote, Westerville; Thomas A. Hochandel, Pickerington, both of Ohio

[73] Assignee: J. E. Grote Pepp-A-Matic Co., Inc., Columbus, Ohio

[21] Appl. No.: 928,509

[22] Filed: Jul. 27, 1978

[51] Int. Cl.[3] ..... B26D 4/42; B26D 4/48

[52] U.S. Cl. ..... 83/409.2; 83/811; 83/820; 83/871; 83/874

[58] Field of Search ..... 83/871, 870, 872, 707, 83/713, 714, 409.2, 411 A, 437, 874, 810, 811, 812, 820, 102.1

[56] References Cited

U.S. PATENT DOCUMENTS

| | | | |
|---|---|---|---|
| 935,805 | 10/1909 | McDonough | 83/813 X |
| 1,383,133 | 6/1921 | Lucke | 83/874 X |
| 1,955,360 | 4/1934 | Ferry | 83/717 |
| 2,126,380 | 8/1938 | Folk | 83/729 |
| 2,580,864 | 1/1952 | Upright | 83/437 |
| 2,605,799 | 8/1952 | Ratti | 83/717 X |
| 2,670,768 | 3/1954 | Yohn | 83/102.1 |
| 2,670,771 | 3/1954 | Lockwood et al. | 83/820 X |
| 2,749,982 | 6/1956 | Hardt | 83/874 |
| 3,263,537 | 8/1966 | Rehman et al. | 83/871 |
| 3,640,166 | 2/1972 | Michals | 83/411 A |
| 3,850,061 | 11/1974 | Wirstrom | 83/813 X |
| 3,851,554 | 12/1974 | Papai | 83/411 A |

*Primary Examiner*—J. M. Meister

*Attorney, Agent, or Firm*—Robert E. Stebens

[57] ABSTRACT

A flexible meat slicing blade and support therefor is provided for utilization in apparatus such as pizza forming machines to provide accurately and uniformly sliced meat products of specified thickness for deposit on a surface of a pizza shell. An elongated flexible meat slicing blade of this invention, which may be a continuous band, is supported for longitudinal movement in a cutting plane with the blade disposed at an angle with respect to that cutting plane. A cutting edge of the blade is beveled at an angle which is slightly less than the angle of inclination of the blade to the cutting plane. A support is provided for the portion of the blade passing through the cutting plane to maintain the flexible blade in precise position with respect to the cutting plane. This support includes a structurally rigid bar having a longitudinal groove in which the effective cutting portion of the blade is disposed for relative sliding movement. This groove is angularly oriented with respect to positioning of the support to receive and maintain the blade at the desired angular position with respect to the cutting plane and maintain the surface of the beveled cutting edge thereof in predetermined relationship to the cutting plane.

12 Claims, 7 Drawing Figures

FLEXIBLE MEAT SLICING BLADE AND SUPPORT THEREFOR

BACKGROUND OF THE INVENTION

The flexible slicing blade and support of this invention is designed for primary utilization in machines and apparatus for the forming of pizzas. Exemplary machines of this type are illustrated in two prior patents issued to one of the co-inventors of this invention. These patents, issued to James B. Grote, are U.S. Pat. No. 3,760,715 issued on Sept. 25, 1973 and U.S. Pat. No. 3,633,450 issued on Jan. 11, 1972. The machines or apparatus illustrated in each of the patents includes the mechanism which provides support for a plurality of sticks of sausage or pepperoni similar meat products in vertical orientation and a band-type slicing blade which operates on the lowermost ends of the sticks of meat to produce a layer of thin meat slices on an underlying pizza shell. The support for the sticks of meat is adapted for reciprocation in parallel relationship to a cutting plane in which the upper run of the cutting blade is designed to continuously revolve in a linear path. In each of these illustrative machines, the cutting blade which is a continuous band, is supported on a pair of pulleys disposed at an angle with respect to this cutting plane. The reason for that inclination is that the cutting blade has a beveled cutting edge and it is desired to present that beveled cutting edge in predetermined relationship to the cutting plane. A suitable motor is provided for revolving the continuous band-type blade in effecting the cutting of the sticks of meat as the support for those sticks of meat is reciprocated along a predetermined path with respect to that cutting plane.

The apparatus, as shown in these two specifically noted patents, while operative for the illustrative apparatus is not capable of performing the desired function with the degree of accuracy as to uniformity and thickness of the meat slices and proper adjustment of the thickness of such slices where the apparatus must be operative over a relatively long horizontal span. Some machines for the forming of pizza are in effect double line machines which are capable of simultaneously operating on two longitudinally moving lines of pizza shells and two meat supporting structures. With such long spans for the cutting blade in the upper run which may easily be of the order of three foot, this span is of such extent that the flexible blade is incapable of maintaining the necessary linearity throughout its entire length during cutting operations. Very frequently, during such cutting operations, the forces produced in transporting the vertically supported sticks of meat across the cutting plane and against the cutting blade, are sufficient to cause bowing or bending of the cutting blade. The blade may be either a bowed downwardly out of the cutting plane or bent rearwardly in its own plane, or there may be a multiple type deformation of blade to include both bowing and bending with the undesirable result of uncontrollable variations in the meat slices that are produced. Specifically, the blade is incapable of being maintained in a linear and planar configuration throughout its entire length in the cutting plane and results in a substantial and highly undesirable nonuniformity in the thickness of the meat slices as applied to any particular pizza. In fact, the meat slices across the entire width of a single pizza may vary to such a degree that the pizza is not particularly desirable from the standpoint of looks and, even more importantly, to obtain at least a minimum thickness slice, it is necessary to adjust the thickness of cut so that some slices of the meat will be thicker than otherwise necessary. As a consequence, the cost will be materially increased and thereby constitutes a substantial detriment to the economics of the semi-automated pizza manufacturing operations.

SUMMARY OF THE INVENTION

A flexible meat slicing blade and support therefor is provided in accordance with this invention to enable one to maintain the constant linearity of an elongated, flexible cutting blade over a substantial horizontal plane such as a length of about three foot. The support and blade are positioned to support the required length of the cutting blade in the cutting plane and maintain the cutting edge thereof at a precise vertical and angular position with respect to that cutting plane. The support for the cutting blade is a structurally rigid bar which is mechanically coupled and secured to the structure of the apparatus and is provided with an elongated slot or groove in which a length of the slicing blade is supported for linear displacement. Suitable driving means is coupled to the blade and may include a pair of pulleys or rollers around which a continuous blade of the band-type may be trained and continuously revolved during cutting operations.

In addition to providing a structurally rigid support for the blade, particularly as to the portion thereof extending through the cutting plane, the blade and its support are relatively configured so that the beveled cutting edge of the blade has a surface which is supported in generally coplanar relationship to a surface of the support bar. This surface of the support bar is thus aligned in the cutting plane and provides additional support for the sticks of meat products during their travel across the cutting plane and particularly during the movement of the meat sticks to a base or starting position in a reverse direction across the support bar and cutting blade. In accordance with the invention, the cutting blade is formed with a beveled edge and is angularly positioned with respect to the support bar so that the beveled surface is at a slight angle relative to the surface of the support bar. This configuration places the heel of the blade edge slightly below the support bar surface and thus prevents interference and obstruction to the reverse travel of the meat sticks across the cutting area thereby avoiding the cutting or tearing of the meat during such reverse travel and the otherwise consequent forming of waste meat particles that would interfere with further cutting operations and to also reduce the cost of operation through elimination of this waste.

In addition to providing the novel arrangement of a supporting bar in combination with a flexible slicing blade, this invention provides transport plates defining a cutting plane at either side of the cutting blade which include means for selective adjustment in a vertical direction. The specific means, in combination with the cutting blade and its support, enables the apparatus to be precisely positioned to effect cutting of meat slices having an exact thickness which can be continuously maintained during prolonged operation of the apparatus. The vertical adjustments include a combination of mechanisms for effecting vertical adjustment of the plate preceding the cutting blade with respect to the cutting blade.

These and other objects and advantages of this invention are readily apparent from the following detailed description of an illustrative embodiment thereof and the accompanying drawings.

DESCRIPTION OF THE ILLUSTRATIVE EMBODIMENT

Figure 1:
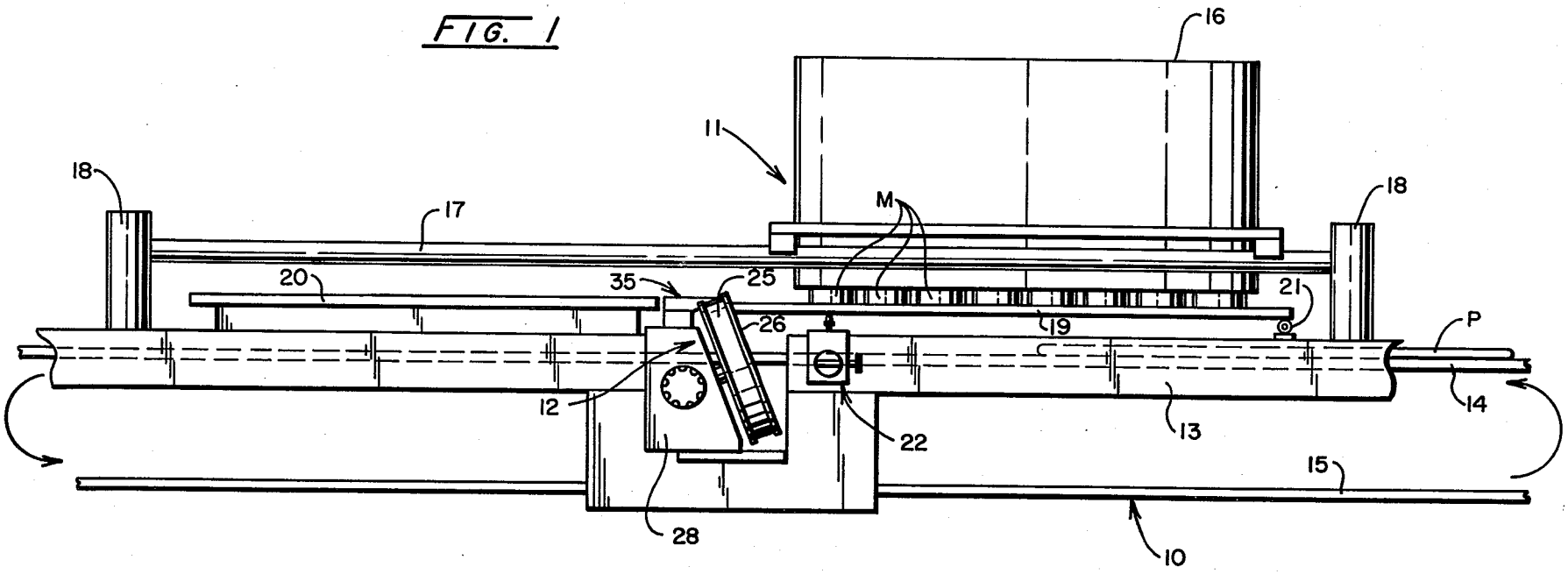
FIG. 1 is a vertical side elevational view of a pizza forming apparatus including the flexible meat slicing blade and support of this invention.

An apparatus for the slicing of meat products in the semi-automated formation of pizzas is illustrated in FIG. 1. This apparatus, as in the case of the apparatus described and illustrated in the previously issued patents to one of the co-inventors hereof, specifically U.S. Pat. Nos. 3,760,715 and 3,633,450 includes a transpactor conveyor mechanism 10 for the transport of pizza shells P, a meat product carrier 11 and product slicing means 12. Each of the three components are illustrated as being mounted on or carried by a suitable structural framework as represented by an elongated frame elements 13 in FIG. 1. Supported and carried by this frame 13 is the conveyor mechanism 10 which is illustrated as including an elongated conveyor belt, having upper and lower runs 14 and 15. Supports and actual construction of the conveyor belt 10 are not illustrated as these do not form a part of this invention. It will suffice to note that the upper run of the conveyor belt 14 is supported to be displaced along a longitudinal plane in substantial alignment with the frame member 13 and, as will be hereinafter noted, in effectively parallel relationship to a cutting and transport plane for the meat products. A single pizza shell P is shown supported on the upper run 14 of the conveyor and in the illustrated embodiment will be noted as being transported from the right to the left of FIG. 1. During the course of this transport, the pizza shell P will thus transverse the operative area of the product slicing means 12 and as, in accordance with the structures of previously noted patents, will receive a layer of meat product slices which may be a pepperoni or sausage type meat product. The specific product is not material to the desdescription and understanding of the invention and it will be understood that various types of products may be handled by this apparatus and deposited on the surface of the pizza shell P.

A meat product carrier 11 is provided, as indicated, and includes a supporting turret 16 for these meat products which are generally provided in the forms of elongated cylindrical sticks. This turret 16, as in accordance with the description of the previously noted patents for such apparatus, includes an interior wall structure forming a plurality of individual cells of open ended configuration in which each of the individual sticks of meat are vertically disposed. The sticks of meat are merely dropped into the open top ends of the respective cells and are fed by gravity out through the open bottom ends. In FIG. 1 only the lower end portions of the sticks of meat M are seen projecting below the lowermost edge of that supporting turret 16. The turret 16 itself is mounted for longitudinal sliding reciprocation of elongated, horizontally disposed support bars 17. The opposite ends of the support bars are secured in upstanding brackets 18 that are attached to appropriate elements of the structural frame 13 and support the turret 16 for movement in a plane that is parallel to the cutting plane and the transport plane for the pizza shells P.

Also included as a part of the meat product carrier 11 are a pair of horizontally disposed plates 19 and 20. These plates are mounted on and secured to the frame 13 with plate 19 normally supporting the meat sticks in the turret 16 when it is positioned as shown in a base or starting position. The meat sticks slide on the surface of the underlying plate 19 during transport across the cutting means 12 onto the plate 20 where they are similarly supported. The plate 19 preferably mounted to permit relative vertical adjustment of one end the plate and thereby enable adjustment of the thickness of the slices of the meat products that may be produced by this apparatus. Accordingly, it will be seen in FIG. 1, that plate 19 is secured at an end remote to the slicing means 12 by a hinge structure 21 and the end adjacent the slicing means disposed in cooperative relationship to an adjusting mechanism 22. The other plate 20 is mounted in fixed relationship to the structural frame 13.

Operation of the meat product carrier 11 will be seen to comprise a longitudinal reciprocating movement of the meat supporting turret 16 as between the plates 19 and 20. With the supporting structure 16 positioned as illustrated in FIG. 1, the lower ends of the meat sticks M are thus resting on the surface of the plate 19 and will be transferred to the upper surface of plate 20 as the turret 16 is moved to the left of FIG. 1. During the course of this movement, the lower ends of the meat sticks M will thus come into operative engagement with the slicing means 12 which will sever a meat slice of a predetermined thickness and which slice is then deposited onto the pizza shell P. It will be understood that a plurality of such slices are simultaneously produced and deposited on the shell. This operation is coordinated in order that the pizza shell will be transported at the same rate of movement as the turret 16 thereby resulting in the several slices being deposited in a predetermined pattern on the pizza shell. This pattern is determined in the first instance by arrangement and number of meat sticks M that may be contained in the turret 16.

Suitable mechanisms for effecting the concurrent and simultaneous transport of the supporting structure 16, as well as the conveyor 10, are not shown and it will be understood that this operation may be performed manually by the operator if so desired. However, as an illustrative example of suitable mechanisms for effecting the automated operation, it will be understood that the conveyor 10 may be continuously driven and appropriate mechanized reciprocating devices may be interconnected with the turret 16 of the meat product carrier. Control mechanisms, also not shown, would also be provided and control operations in timed relationship to the advancement of a pizza shell P on the conveyor 10. Those actuating mechanisms would be operable to displace the turret 16 at the same rate of travel of the pizza shell P and, when the turret 16 has been fully advanced from the right to the left onto supporting plate 20, these mechanisms would automatically effect the reverse movement of the supporting structure to its illustrated starting position at the right of FIG. 1. This would be accomplished in timed relationship to the advancement of successive pizza shells P that may be carried on the upper run 14 for the conveyor.

Figure 2:
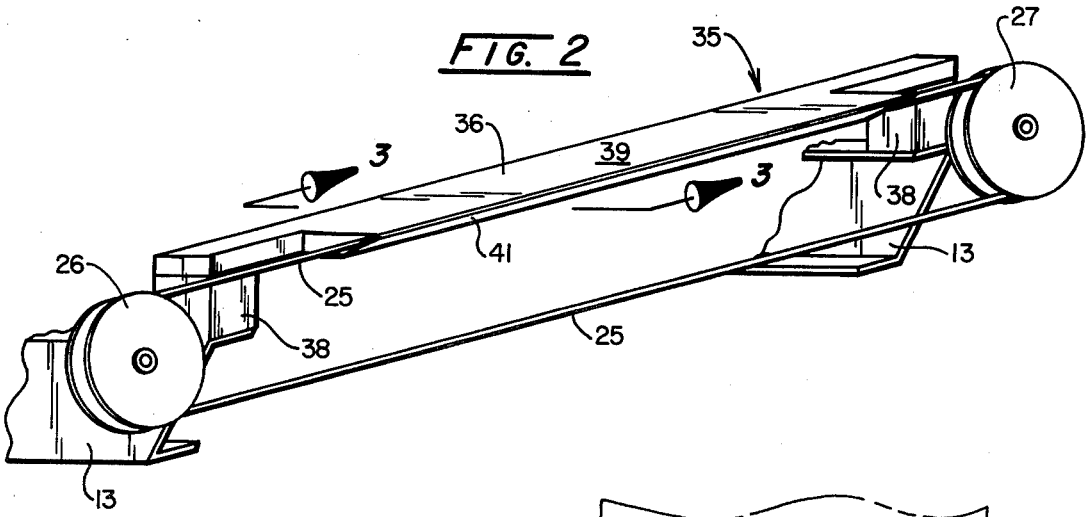
FIG. 2 is a diagrammatic perspective view of a cutting blade and its support.

Improved cutting and precise control of slice thickness is achieved through the novel structural arrangement and components of the slicing means 12 of this invention. Included in the product slicing means 12, is a continuous band-type cutting blade 25 which is trained about driving and support pulleys 26 and 27. Each of the pulleys 26 and 27 is journaled on a respective supporting bracket 28 and 29 with each bracket being mounted on and carried by the structural frame 13. It will be most clearly seen in FIG. 2 that this support of the band-type cutting blade 25 is also arranged to maintain the plane of revolution of that blade at an angle in respect to a horizontal plane which is the cutting plane of the apparatus. Referring to both FIGS. 1 and 2, it will be seen that the blade is angled upwardly with respect to the direction from which the meat supporting turret 16 will be moved in a cutting operation. This upward inclination of the blade thus enables the blade to better perform its cutting operation without interference due to the interengagement of the several meat sticks as they pass over the blade. This angular arrangement of the cutting blade is utilized and shown in the two previously issued patents to the co-inventor hereof.

Figure 3:
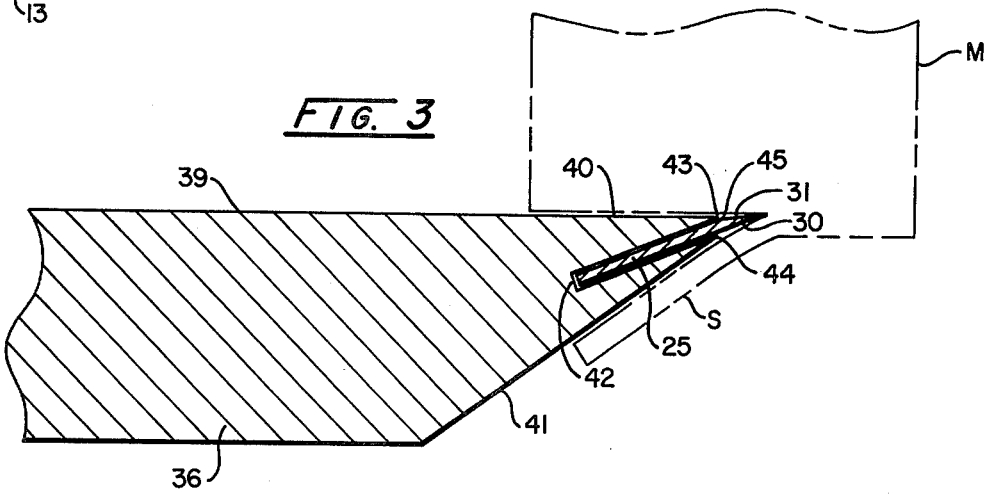
FIG. 3 is a fragmentary vertical sectional view on a substantially enlarged scale taken along line 3—3 of FIG. 2.

Additionally, it will be noted that the cutting blade 25, at its leading edge, is provided with a cutting edge 30 having a single beveled surface 31 which is angled with respect to the plane of the blade. This configuration can be best seen in FIG. 3 where it will be noted that the beveled surface 31 is disposed in substantially parallel relationship to the horizontal cutting plane. In that figure, a lower end portion of a single meat stick M is shown in broken lines as passing the cutting blade in cutting relationship thereto as in the performance of a slicing operation. During this operation, it will be noted that a relatively thin slice of the meat stick designated S will be severed and permitted to drop downwardly onto a pizza shell as described in the previously noted patents.

To improve the ability of the apparatus to precisely cut slices of an exact predetermined thickness across the entire width of the cutting area, the apparatus includes a supporting guide 35 for the upper run of the cutting blade 25. This supporting guide 35 can be best seen in FIG. 2 and includes an elongated guide bar 36 having terminal mounting portions 37 at each end, which facilitate mounting of the guide bar. These terminal end portions 37 are secured to respective mounting blocks 38 which are secured to respective longitudinal elements of the structural frame 13. The guide bar 36 has an upper surface 39 which is maintained in a substantially horizontal plane when mounted on the apparatus. This upper surface 39 is vertically positioned to be substantially aligned with the cutting plane and is contiguous to the upper surface of the plate 20. Also as will be described hereinafter the guide 35 is positioned at an elevation relative to the upper surface of the plate 19 to determine the thickness of the meat slices S severed from the several meat sticks. This relative difference in vertical elevation is selectively and precisely controlled by setting of the adjusting mechanism 22 in accordance with the requirements of a specific cutting and slicing operation.

Forming at the leading edge of the guide bar 36 is a longitudinal edge portion having a V-shaped cross-section with the one surface thereof 40 being a continuation of the upper surface 39 of the guide bar. The opposite surface 41 of this V-shaped edge portion is relatively divergent thereto in a downwardly and rearwardly directed relationship. Formed in the leading edge portion is a longitudinally extending groove or recess 42 designed to receive the cutting blade 25. This blade groove 42 is formed in the leading edge portion so as to open the apex of the surfaces 40 and 41 and is of a depth such that the blade 25, when fully inserted therein, will have only its cutting edge 30 projecting outwardly from the guide bar. The depth of the groove 42 is determined by the width of the blade 25 and is formed so that only the cutting edge 30 will be projecting from the apex of the surfaces 40 and 41. The extreme end edge 43 between the groove 42 and the surface 40 may have a blunt edge but the end edge 44 between the groove 42 and the surface 41 is preferably knife sharp to improve separation of the meat slice S as it is severed.

To achieve the optimum slicing operation, the V-shaped end portion of the guide bar and the angular relationship between its surfaces 40, 41 and the cutting blade 25 are determined so that a slice S as it is severed will properly fall from the apparatus onto the pizza shell which is traveling in concurrent relationship thereto. These specific angular relationships include the angle of the beveled edge 30 of the cutting blade and which is related to the included angle of the surfaces 40 and 41 at leading edge of the guide bar 36. In accordance with this invention, the angles which have been found to be most advantageous, is an angular relationship of the guide bar slice deflecting surface 41 to the upper horizontal surface 40 of 35° whereas the angle of the blade groove 42, with respect to the surface 41 is 20°. This relationship, as can be best seen in FIG. 3, results in the extreme edge 43 at the upper surface 40 having a blunt edge even though this edge is of relatively narrow dimension. However, the deflecting edge 43 at the surface 41 is preferably formed so as to be knife-sharp and thus result in a very clean breaking of a meat slice S as it is severed by the blade 25.

To further obtain the most advantageous operation, the beveled cutting edge 30 of the blade 25 has an included angle which is slightly less than the angle of the blade with respect to the horizontal. This angle is preferably 15° thus resulting in the heel 45 of the cutting edge surface being slightly below the surface 39 and its contiguous extension 40 when the extreme cutting point is positioned in the plane of that surface. The particular advantage of this slightly lessor angle is that the blade does not interfere in the return movement of the meat sticks M as they pass from the left to the right of the apparatus as shown in FIG. 1. If the heel 45 of the cutting edge surface 31 is also in the plane of that guide bar surface 40 there is a tendency for the meat sticks to hang up or be engaged by the blade to a substantial extent and thus prevent the relatively free movement of the meat sticks. This also results in the generation of particles of meat that tend to clog the apparatus and interfere with cutting operations.

The structure as hereinbefore described has been directed to a guide bar 36 wherein the deflecting surface 41 is a smooth planar surface. This smooth planar surface, while particularly useful with respect to meat products such as pepperoni and sausage, is not entirely suitable for other types of meat products such as Canadian bacon due to inherent characteristics of such meat products. Canadian bacon, for example, has a substantial tendency to adhere to a smooth planar surface and may remain on the cutting bar rather than freely drop onto the pizza shell or other article that may be transported beneath the blade thereby either clogging the cutting blade or producing an undesireable pattern of meat slices.

Figure 4:
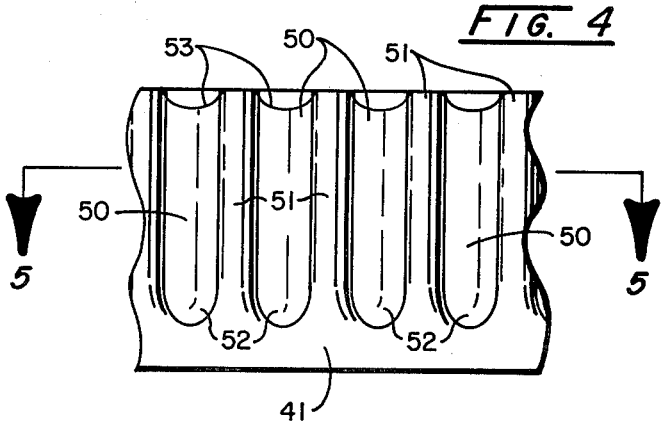
FIG. 4 is a fragmentary plan view of a beveled surface of the support bar.
Figure 5:
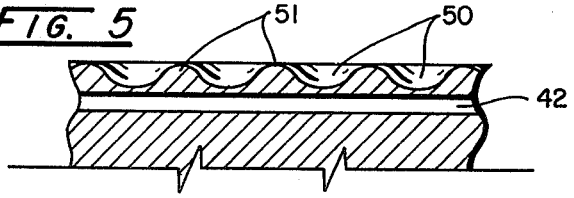
FIG. 5 is a fragmentary sectional view of the support bar taken along line 5—5 of FIG. 4.

To avoid the hanging of a meat slice on the surface 41 which is cut from a stick of Canadian bacon, it is preferred that this deflecting surface 41 be configured as is shown in FIGS. 4 and 5 of the drawings. In this modified form of the guide bar 36, the deflecting surface 41 is provided with a number of alternatingly disposed grooves or recesses 50 and ribs 51 which extend transversely to the longitudinal axis of the guide bar 36. These grooves 50 terminate in rounded closed ends 52 at the end most remote from the edge 44 and are relatively spaced to thereby define the ribs 51. The ends 53 of the grooves 50 and adjacent portions of the ribs 51 are arcuately scalloped due to the tapering of the guide bar to a knife edge 44. These grooves and ribs 50 and 51 are particularly effective in reducing the contact surface area which engages the meat slices as they are severed by the cutting blade thereby significantly reducing the likelihood that Canadian bacon or similar characteristic materials will adhere to the surface 41. With such grooves and ribs, the slices of such materials will also be cleanly deflected and thus enable the slices to be deposited by gravity on any underlying and suitable support or transport mechanism or surface.

Figure 6:
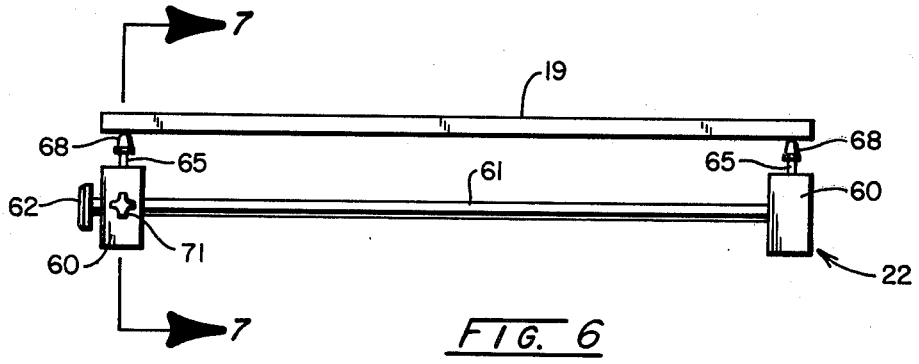
FIG. 6 is a fragmentary vertical sectional view taken along line 6—6 of FIG. 1.
Figure 7:
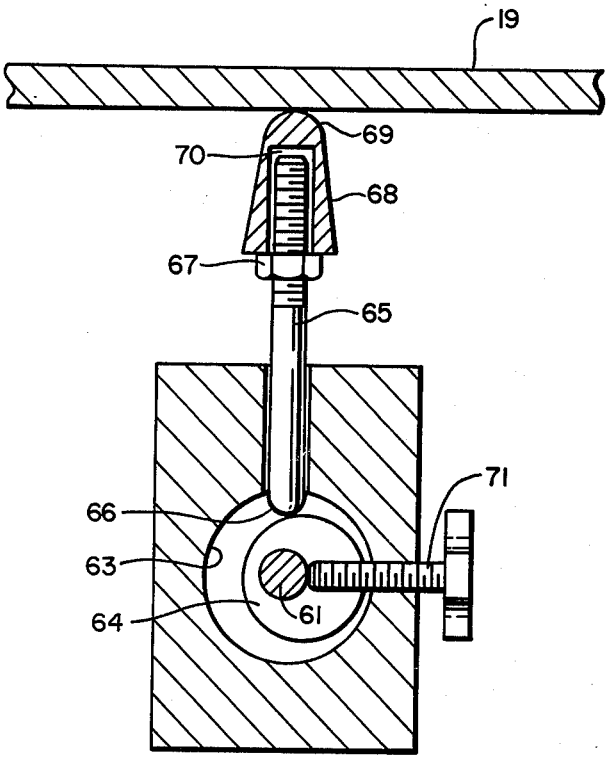
FIG. 7 is a vertical sectional view taken along line 7—7 of FIG. 6.

Selective adjustment of the plate 19, as previously indicated, is accomplished by operation of the adjusting mechanism 22. This specific adjustment mechanism, which is particularly advantageous for utilization in this apparatus, is illustrated in greater detail in FIGS. 6 and 7 of the drawings. Included in this mechanism are the two laterally spaced supporting blocks 60 which are secured or mounted on the respective side-elements of the structural frame 13. Extending transversely across the apparatus is an elongated rod 61 or shaft which is journaled in the respective supporting blocks 60. One end of this shaft projects a distance outwardly from its respective block and is provided with an operating knob 62. Mounted in fixed relationship on the shaft 61 within an interior cavity 63 of each supporting block 60 is a respective eccentric cam 64. Mechanical coupling of each section of the adjusting mechanism with the plate 19 is effected by a vertically extending pushrod 65 which extends through a vertically disposed socket 66 opening to the interior of the cavity with the lower end 66 of the push rod contacting the surface of the eccentric cam 64. The upper end of the push rod 65 is formed with a threaded section on which a nut 67 is turned to a selected position. A cap element 68 is positioned over the upper threaded section of each push rod 65 and includes an upper end portion 69 that bears against the lower surface of the plate 19. These caps 68 include an elongated socket 70 that opens at the bottom which rests on the nut 67. Turning of the nut 67 thus raises or lowers the cap 68 and thereby provides a limited degree of adjustment of vertical height and is useful in obtaining precise alignment of the two adjusting mechanism with respect to each other. Turning of the operating knob 62 thus will rotate the shaft 61 and simultaneously angularly position the cams 64 in a selected position for the desired relative vertical elevation of the plate 19. Securing the mechanism at the desired position is achieved by a locking screw 71 which is threaded into one of the supporting blocks 60 and has an inner end that bears against the shaft 61. The shaft 61 provides for convenient simultaneous elevation of both respective push rods 65 while the adjusting nuts 67 may be turned to obtain a precise planar alignment of the plate 19 with the cutting blade 25 as well as with respect to the defined cutting surface.

From the foregoing detailed description of the illustrative embodiment of this invention, it will be readily apparent that a particularly novel and advantageous structure is provided in the combination of a slicing blade and support in a cutting apparatus such as that incorporated in machines for applying meat slices to pizza shells. The providing of a rigid support bar for the portion of cutting blade which extends through the cutting plane enables the apparatus to maintain a precise and accurate slice thickness over the entire width and extent of the cutting area. This arrangement enables the apparatus to be constructed to accommodate extremely large sizes of pizzas as well as to accommodate a plurality of pizza shells that are transported in side-by-side relationship. Forming the support bar with a specifically configured angular relationship of the blade-receiving groove, in combination with the particular beveled angle of the cutting blade, results in a particularly advantageous structure that substantially eliminates the tendency of the meat products interfering with the operation of that blade during reverse travel. The relatively recessed relationship of the heel of a beveled cutting surface, with respect to the upper transport surface of a guide bar, prevents the meat products from engaging the blade and inadvertently resulting in a cutting or tearing operation during reverse movement of the meat sticks from the one position to the other across that cutting blade.

Formation of the specific angled relationship of the deflecting surface of the cutting bar also materially aids in the clean separation of the meat slices as they are severed, to further assure that those meat slices will be dropped in the desired pattern onto the surface of a pizza shell that is concurrently transported with the meat supporting turret. Also, the alternate formation of that deflecting surface, with the series of grooves and intervening ribs, substantially reduces the effective contacting surface area which is extremely effective in preventing the severed meat slices from tending to adhere to that surface and block or interfere with further cutting operations. Also, the ability of the groove and rib surface to cleanly separate the severed meat slices further assures that these meat slices will be deposited in the desired pattern on the pizza shell or other supporting surface.

It will be further noted that the precise control in the operation of the apparatus, is greatly facilitated through the providing of the illustrative types of verticle adjustment mechanisms for the support plate. These adjusting mechanisms, which incorporate both a means for obtaining precise relative alignment between laterally spaced points as well as the concurrent and simultaneous verticle adjustment, assures that the plate on which the meat sticks are supported immediately prior to a cutting operation are supported at a relative height with respect to the cutting edge to obtain the predetermined thickness meat slice. The combination of the adjusting mechanisms and the rigid supporting bar for the blade assure that a constant slice thickness is maintained across the entire width of the cutting area.

Having thus described this invention, what is claimed is:

1. A slicing apparatus comprising slicing means including an elongated flexible cutting blade having a longitudinally extending cutting edge formed along one marginal edge portion of said blade, said cutting edge being formed with a longitudinally extending beveled surface that is angularly disposed at a predetermined angle relative to the plane of the blade, and drive means coupled therewith for support of a longitudinally extending portion of said blade in linearly disposed relationship with the plane of the blade disposed in angularly oriented relationship to a cutting plane and having a longitudinally extending terminal edge of the cutting edge projecting into the cutting plane, said drive means operable to effect longitudinal displacement of said blade in performance of cutting operations, and guide means for said cutting blade including a structurally rigid guide bar supported in relatively fixed relationship to the cutting plane, said guide bar having an elongated slot formed therein for receiving the portion of said blade disposed in angularly oriented relationship to the cutting plane and supporting that portion of the blade against displacement in either axis transverse to the longitudinal dimension of the cutting blade, said guide bar including a support surface and a deflecting surface with both extending longitudinally of said bar in colinearly extending relationship to said slot with the guide bar support surface disposed in substantially contiguous and parallel relationship to the cutting plane and having said support and deflecting surfaces disposed in relatively divergent relationship to said slot with said slot disposed relative to said guide bar support surface to place the beveled surface of said blade cutting edge adjacent to the cutting plane and in divergently angled relationship to said support surface and cutting plane.

2. A slicing apparatus according to claim 1 wherein said cutting edge projects laterally out of said guide bar slot with an opposite longitudinal edge of said blade disposed in sliding contacting engagement with a bottom of said slot.

3. A slicing apparatus according to claim 1 wherein the angle of slot with respect to said guide bar support surface is about 20 degrees, and the included angle of said blade cutting edge is about 15 degrees.

4. A slicing apparatus according to claim 1 wherein said guide bar deflecting surface terminates at said slot in a sharp edge.

5. A slicing apparatus according to claim 4 wherein the included angle between said guide bar support surface and said deflecting surface is about 35 degrees.

6. A slicing apparatus according to claim 1 wherein said guide bar deflecting surface is formed with a smooth planar surface.

7. A slicing apparatus according to claim 1 wherein said guide bar deflecting surface is formed with a plurality of longitudinally spaced grooves extending transversely of said guide bar with the one end thereof terminating at said slot.

8. A slicing apparatus according to claim 7 wherein said grooves cooperatively define a rib between each adjacent pair of grooves, said ribs being of relatively narrow width.

9. A slicing apparatus comprising slicing means including an elongated flexible cutting blade, drive means coupled therewith for support of at least a portion of said blade in a cutting plane and operable to effect longitudinal displacement of said blade in performance of cutting operations, guide means for said cutting blade including a structurally rigid guide bar supported in relatively fixed relationship to the cutting plane, said guide bar having an elongated slot formed therein for receiving the portion of said blade disposed in the cutting plane and supporting that portion of the blade against displacement in either axis transverse to the longitudinal dimension of the cutting blade, a product carrier supported in operative relationship to said slicing means and said guide means for transport of product to be sliced with respect to said cutting blade, said product carrier including a turret which receives the product and displaceable in a plane parallel to the cutting plane, and a product support plate disposed at a leading side of said cutting blade for controlling the thickness of the product slices, said product support plate including thickness adjusting means for positioning an edge portion of said plate adjacent said cutting blade in selected spaced relationship to the cutting plane, said thickness adjusting means including an elongated shaft extending parallel to the cutting plane and supported for relative rotation about its longitudinal axis, a pair of eccentric cams fixed on said shaft in axially spaced relationship for rotation therewith, and means mechanically coupling said cams with said product support plate for effecting vertical displacement of the support plate edge portion in accordance with selective operation of the adjusting mechanism to rotate said cams.

10. A slicing apparatus according to claim 9 wherein said thickness adjusting means includes a pair of vertically extending push rods mechanically coupling said cams with said product support plate, said push rods each having one end disposed in contacting engagement with a respective cam and the other end in contacting engagement with said product plate.

11. A slicing apparatus according to claim 10 wherein said push rods are independently adjustable axially as to relative length.

12. A slicing apparatus according to claim 10 wherein said product support plate is supported for rotational movement by hinge means disposed in spaced relationship to said push rods, said push rods disposed adjacent the edge portion of said product support plate disposed adjacent said cutting blade.

* * * * *